US010922935B2

(12) United States Patent
Child et al.

(10) Patent No.: US 10,922,935 B2
(45) Date of Patent: Feb. 16, 2021

(54) DETECTING A PREMISE CONDITION USING AUDIO ANALYTICS

(71) Applicant: Vivint, Inc., Provo, UT (US)

(72) Inventors: Michael David Child, Lehi, UT (US); Jeremy B. Warren, Draper, UT (US)

(73) Assignee: Vivint, Inc., Provo, UT (US)

( * ) Notice: Subject to any disclaimer, the term of this patent is extended or adjusted under 35 U.S.C. 154(b) by 606 days.

(21) Appl. No.: 14/304,644

(22) Filed: Jun. 13, 2014

(65) Prior Publication Data

US 2015/0364028 A1 Dec. 17, 2015

(51) Int. Cl.

| | |
|---|---|
| ***G08B 13/16*** | (2006.01) |
| ***G08B 1/08*** | (2006.01) |
| *G08B 13/196* | (2006.01) |
| *G08B 21/10* | (2006.01) |

(52) U.S. Cl.

CPC ..... *G08B 13/1672* (2013.01); *G08B 1/08* (2013.01); *G08B 13/19695* (2013.01); *G08B 21/10* (2013.01)

(58) Field of Classification Search

CPC ..... G08B 13/1672; G08B 1/08; G08B 13/19695; G08B 21/10

See application file for complete search history.

(56) References Cited

U.S. PATENT DOCUMENTS

| | | | | |
|---|---|---|---|---|
| 6,134,303 | A | 10/2000 | Chen | |
| 6,204,760 | B1 | 3/2001 | Brunius | |
| 6,215,404 | B1 | 4/2001 | Morales | |
| 6,611,206 | B2 | 8/2003 | Eshelman et al. | |
| 7,659,814 | B2 * | 2/2010 | Chen | G08B 25/08 340/531 |
| 8,121,078 | B2 | 2/2012 | Siann et al. | |
| 8,531,286 | B2 | 9/2013 | Friar et al. | |
| 2004/0151282 | A1 | 8/2004 | Jones, III et al. | |
| 2005/0131705 | A1 * | 6/2005 | Gandhi | G08B 13/1672 704/273 |
| 2007/0096927 | A1 | 5/2007 | Albert | |
| 2007/0183604 | A1 * | 8/2007 | Araki | G10L 17/26 381/58 |
| 2010/0127878 | A1 * | 5/2010 | Wang | G10L 17/26 340/573.1 |

(Continued)

FOREIGN PATENT DOCUMENTS

| | | |
|---|---|---|
| CH | 706631 A2 | 12/2013 |
| WO | 2011025085 | 3/2011 |

OTHER PUBLICATIONS

English Translation of Korean Patent Publication 101299988 (Year: 2013).*

(Continued)

*Primary Examiner* — Patrick N Edouard
*Assistant Examiner* — Eboni N Giles
(74) *Attorney, Agent, or Firm* — Holland & Hart, LLP

(57) ABSTRACT

Methods and systems are described for detecting a premise condition. According to at least one embodiment, a method for detecting a premise condition includes detecting a sound with a security system component, determining with the security system component whether the sound belongs to a recognized class of sounds, sending the recognized class to a remote control unit, and causing with the remote control unit a predetermined response to occur based on the recognized class.

19 Claims, 9 Drawing Sheets

(56) References Cited

U.S. PATENT DOCUMENTS

| | | | | |
|---|---|---|---|---|
| 2012/0098918 | A1* | 4/2012 | Murphy | H04N 7/147 348/14.01 |
| 2013/0039497 | A1 | 2/2013 | Ramalho et al. | |
| 2013/0176119 | A1* | 7/2013 | Engel | B60R 25/10 340/428 |
| 2015/0112678 | A1* | 4/2015 | Binks | G10L 25/48 704/236 |
| 2016/0005305 | A1* | 1/2016 | Couper | G08B 25/10 340/539.11 |

OTHER PUBLICATIONS

International Search Report and Written Opinion of the International Searching Authority for PCT/US2015/035119, dated Aug. 31, 2015.
English Machine Translation for CH706631 A1, Dec. 31, 2013.
Supplementary European Search Report for EP Application No. 15807201.7, dated Jan. 31, 2018 (8 pp.).

* cited by examiner

DETECTING A PREMISE CONDITION USING AUDIO ANALYTICS

BACKGROUND

Homeowners are often concerned about the security of their homes and accordingly install security cameras to monitor the premise of their homes. Such video cameras capture footage of the events within their field of view when the video cameras are turned on. The footage of the video camera is often stored locally on the camera or sometimes the video footage is sent to a remote location where the footage is accessible to the homeowners.

SUMMARY

Methods and systems are described for detecting a premise condition. According to at least one embodiment, a method for detecting a premise condition includes detecting a sound with a security system component, determining with a security system component whether the sound belongs to a recognized class of sounds, sending the recognized class to a remote control unit, and causing with the remote control unit a predetermined response to occur based on the recognized class. In some embodiments, the security system component is a video camera. However, in other examples, the security system component is a motion detector or another type of security system component.

Any appropriate type of recognized class may be used in accordance with the principles described in the present disclosure. For example, at least one of the recognized classes may include a security class, a health condition class, a property damage class, an alarm class, another type of recognized class, or combinations thereof. The sounds that belong to at least one of the recognized classes may include the sounds of a crying baby above a predetermined threshold, barking dogs sounds, breaking glass sounds, talking sounds, fire alarms sounds, carbon monoxide alarms sounds, other types of alarms sounds, other types of sounds, or combinations thereof.

Any appropriate type of predetermined response may be implemented in response to determining that a sound is from one of the recognized classes. For example, a non-exhaustive list of predetermined responses may include causing a security camera to exit a sleep mode, sending a message to law enforcement, sending a message to medical personnel, displaying a message on a security panel, activating an alarm, sending a notification to a mobile device, locking a door, unlocking a door, performing another predetermined response, or combinations thereof.

In another aspect of the principles described herein, a video camera is configured for detecting a premise condition. The video camera includes a processor, memory in electronic communication with the processor, and instructions stored in the memory. The instructions are executable by the processor to detect a sound with a microphone in the video camera, determine with the video camera whether the sound belongs to a recognized class of sounds, and send the recognized class to a remote control unit.

In yet another aspect of the principles described herein, a computer program product is used for detecting a premise condition. The computer-program product includes a non-transitory computer-readable medium having instructions thereon. The instructions are executable by a processor to detect a sound with a security system component, determine with the security system component whether the sound belongs to a recognized class of sounds, send the recognized class to a remote control unit, and cause with the remote control unit a predetermined response to occur based on the recognized class.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
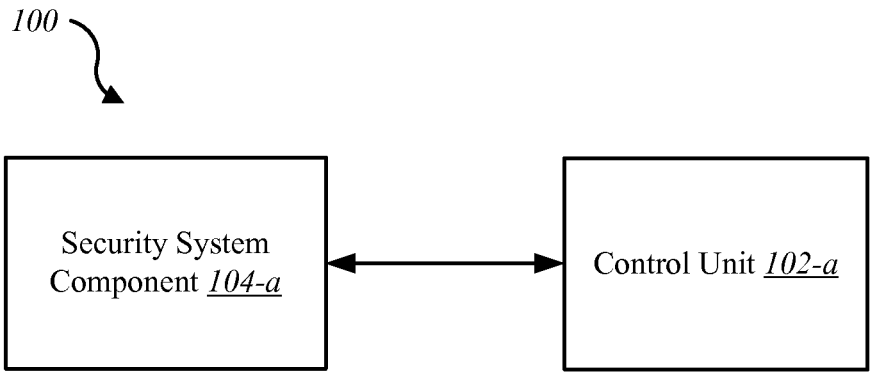
FIG. 1 is a block diagram of an example of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The systems and methods described herein relate to home automation and home security, and related security systems and automation for use in commercial and business settings. More specifically, the system and methods relate to detecting a premise condition using audio analytics. Sounds occurring on or near the premise can be detected and analyzed. In response to the analysis, the system and methods can be implemented to perform tasks that are responsive to the detected sounds. In other words, a predetermined action may be initiated in response to determining that the sound is of a certain type. As an example, if the sound of breaking glass is a predetermined classification of sounds of interest, the sound of breaking glass may trigger a camera to turn on, while the sound of the neighbor's lawn mower will not trigger the camera to turn on.

As used herein, the term "module" includes a combination of hardware and programmed instructions that are necessary for performing the designated function of the module. Components of the modules may be located on the same physical device or some of the components may be located at remote locations that are in communication with the other components of the module.

FIG. 1 is a block diagram depicting one embodiment of an environment 100 in which the present systems and methods may be implemented. In some embodiments, the environment 100 includes a control unit 102-*a* that is in communication with a security system component 104-*a*. The control unit 102-*a* may also be in communication with components of other systems, such as lighting systems, climate control systems, home automation systems, other types of systems, or combinations thereof. The control unit 102-*a* may be in direct communication with the security system component 104-*a* or in indirect communication with the security system component 104-*a* through an intermediate device, such as a cloud based device, a mobile device, another type of device, or combinations thereof.

Any appropriate mechanism for communicating between the control unit 102-*a* and the security system component 104-*a* may be used. In some examples, a wireless network is utilized to communicate between the control unit 102-*a* and the security system component 104-*a*. Examples of networks that may be used include, but are not limited to, local area networks (LAN), wide area networks (WAN), virtual private networks (VPN), wireless networks (using 802.11, for example), and/or cellular networks (using 3G and/or LTE, for example), Bluetooth networks, z-wave networks, ZigBee networks, other types of networks, or combinations thereof.

The control unit 102-*a* may control at least a part of the security and/or automation system. For example, other sensors (not shown) and/or actuators (not shown) may send information to the control unit 102-*a* where the signals are processed. The such sensors may include, for example, a camera sensor, audio sensor, forced entry sensor, shock sensor, proximity sensor, boundary sensor, appliance sensor, light fixture sensor, temperature sensor, light beam sensor, three-dimensional (3-D) sensor, motion sensor, smoke sensor, glass break sensor, door sensor, window sensor, carbon monoxide sensor, accelerometer, global positioning system (GPS) sensor, Wi-Fi positioning system sensor, capacitance sensor, radio frequency sensor, near-field sensor, heartbeat sensor, breathing sensor, oxygen sensor, carbon dioxide sensor, brain wave sensor, movement sensor, voice sensor, other types of sensors, or combinations thereof. Such actuators may include, for example, automated door locks, climate control adjustors, lighting adjusters, sensors activation mechanisms, other types of actuators, or combinations thereof.

The control unit 102-*a* may make decisions based on the communications from these sensors. For example, based on the information sent from these sensors to the control unit 102-*a*, the control unit 102-*a* may make a decision to activate an alarm, adjust a climate control setting, open or close a window, lock or unlock a door, control a security parameter, manage energy consumption, check the status of a door, locate a person or item, control lighting, control cameras, receive notifications regarding a current status or anomaly associated with a building, perform another task, or combinations thereof. In some cases, a decision may be decided at one of the local sensors, and the local sensors may or may not notify the control unit 102-*a* of the decision and/or resulting action.

In some examples, the control unit 102-*a* includes a user interface where the user can interact with the control unit 102-*a*. For example, the user can manually give instructions to the control unit 102-*a* to adjust a building parameter or perform another system task.

The security system component 104-*a* may be any appropriate type of security device. For example, the security system component 104-*a* may include a video camera, a microphone, a motion detector, a sensor, another type of security device, or combinations thereof. In response to detecting a sound, the security system component 104-*a* may classify the sound and send the classification to the control unit 102-*a*. Based on the received classification, the control unit 102-*a* may cause a predetermined response to occur. For example, a security type of classification may result in a message being sent to law enforcement and/or turning on a security camera, a health condition type of classification may result in a message being sent to medical personnel, an alarm type classification may result in a message being sent to the user's mobile phone, or combinations thereof.

The security system component 104-*a* may include an ability to detect sounds from the ambient environment. Such a capability may include the ability to determine attributes about the detected sounds. For example, the security system component 104-*a* can determine the waveform generated by the sound, the pitch of the sound, the amplitude of the sound, decibel level of the sound, the reflection characteristics of the sound, the period of the sound's wavelength cycle, the acoustic pressure of the sound, the intensity of the sound, the speed of the sound, the direction of the sound, other attributes of the sound, or combinations thereof.

In some examples, the security system component 104-*b* is located within a building, such as a home. In other examples, the security system component 104-*b* is located outside of the home. In some situations, multiple security system components are used collectively to detect and analyze sounds.

The attributes of the sound can be used to determine the sound's source and to recognize the type of sound. For example, the sound of an automobile driving by the home may be detected by the security system component 104-*a*. The security system component 104-*a* may analyze the detected sound's attributes, such as frequency and amplitude. Such attributes may be compared to sound signatures stored in a sound library within the security system component 104-*a* to determine if there is a correlation between the sound attributes and one of the stored sound signatures. If there appears to be a strong enough correlation, the security system component 104-*a* may conclude that the sound belongs to a particular recognized class of sounds.

In some cases, the recognized class of sounds covers a broad scope, such as automobile sounds. In other examples, the recognized class of sounds includes a narrower scope that gives more detail about the sound. For example, questions such as whether the car is idling in the driveway, whether the automobile is close or far from the home, and other types of questions may be not determined in a class scope with a broad scope. Thus, for appropriate types of sounds, the recognized classes may have narrower scopes to obtain more useful information. In such an example, the length of time that the automobile's sound is detected may be used to help determine whether the sound belongs to a passing by automobile classification or to an idling parked automobile classification. Other attributes may also help determine the distance of the car from the home. For example, the sound's strength may be used to determine whether the sound belongs in a class that recognizes that the sound is close or far from the home.

Further, an analysis of the sound's attributes may also help determine the location of the sound's source. For example, the source of the automobile's sound may be from the street adjacent the home, a street farther away from the home, in the driveway, or at another location. As the sound travels, the integrity of the sound wave may diminish. Further, as the sound travels from the automobile to the security system component 104-*a*, the sound wave may further degrade from interaction with acoustic impedance boundaries, such as walls, other cars, pedestrians, mailboxes, and other boundaries. In one such situation, a portion of the sound's energy will be reflected in a different direction when the sound contacts the wall of the home. The security system component 104-*a* may be able to detect such reflections through a reduction in the sound's strength or other resulting characteristics of the detected sound. Thus, the security system component 104-*a* may be able to determine if the sound is coming from a source on a different side of the home's wall than the security system component 104-*a*. In other examples, the security system component 104-*a* may determine that the sound's source is on the same side of the wall as the security system component 104-*a* when the sound is accompanied by weaker reflected waveforms arriving at the security system component 104-*a* at slightly different times.

Using narrower recognized classes may be appropriate in those situations where the distinctions between the recognized classes are associated with different types of predetermined responses. For example, a predetermined response to a car idling in the driveway may be to turn on a video camera. On the other hand, a car driving by on the street next to the home without stopping may not trigger a response. Thus, a narrow recognized class for idling parked automobiles may trigger a response while a narrow recognized class for automobiles driving by may not trigger a response at all. In some instances, the recognized classes may be narrow enough so that different desired responses do not overlap between recognized classes.

An example of situation where a broad classification is appropriate includes the sound of breaking glass. In such a situation, the homeowner may desire a notification of breaking glass regardless of whether the glass is part of a window, dinnerware, door, cabinet, car window, or other structure. Thus, any sound that is classified as breaking glass may trigger the same type of predetermined response.

In some examples, just those sounds that are associated with a predetermined response will be associated to a recognized class. In other examples, some of the recognized classes correspond with sounds that do not trigger predetermined responses. For example, the security system component 104-*a* may include signatures to sound sources that should not trigger a predetermined response, but may be confused with similar types of sounds that come from sources that should trigger a predetermined response.

In some situations, a homeowner may have the option of assigning the predetermined responses to the different types of sounds stored in the security system component 104-*a*. For example, the homeowner may have the option of notifying law enforcement personnel automatically if the sound of breaking glass is detected. However, the homeowner may also have the option to merely turn on the video camera, send a notification to the homeowner's mobile device, send a video stream to the homeowner's mobile device, take no action, other options, or combinations thereof.

In another example, the detected sound may be a voice of a specific individual. In some cases such voice recognition may be used to determine whether a household resident is home. In response to determining that the resident is home, the predetermined response may include executing specific user preferences. For example, if the user has a preference of an open window during days with certain whether conditions, the system may cause a window to open if the weather conditions are met. In other examples, the detected sound may be the voice of an unwelcomed person in the home. Such an examples may include an estranged spouse, an individual with a restraining order, or another type of unwelcome person. In response to recognizing the sound from such an unwelcome person, law enforcement may be notified, parents may receive notifications, or other types of predetermined responses may be executed.

Figure 2:
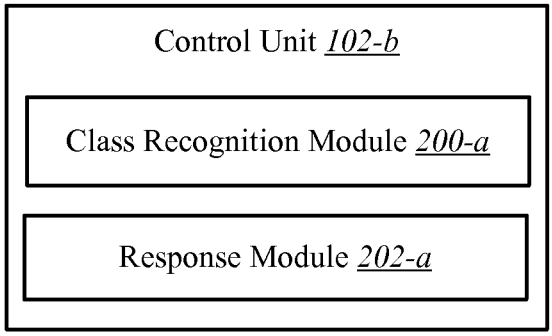
FIG. 2 is a block diagram of an example of a control unit of the environment shown in FIG. 1.

FIG. 2 is a block diagram illustrating one example of a control unit 102-*b*. Control unit 102-*b* may be one example of control unit 102-*a* depicted in FIG. 1. In this example, the control unit 102-*b* has a class recognition module 200-*a* and a response module 202-*a*.

The class recognition module 200-*a* may receive the identification of the recognized class from the security system component 104-*a*. In response to receiving the identification of the recognized class, the security system component 104-*a* may consult with a table that associates the types of predetermined responses with the recognized classes. Based on the associations, the control unit 102-*b* may send a message to the response module 202-*a* with instructions to execute a predetermined response.

The response module 202-*a* may include programmed code to cause the predetermined responses to be carried out. In some examples, the class recognition module 200-*a* does not send instructions to the response module 202-*a* if the table indicates that there is no assigned predetermined response associated with the received recognized class. In other examples, the class recognition module 200-*a* notifies the response module 202-*a* that there is no predetermined response to execute. Each recognized class may be associated with no predetermined response, a single predetermined response, or multiple predetermined responses. For example, a security related class may be associated with predetermined responses for turning on video cameras, notifying law enforcement personnel, sending a notification to the user's mobile device, and other types of predetermined responses.

Figure 3:
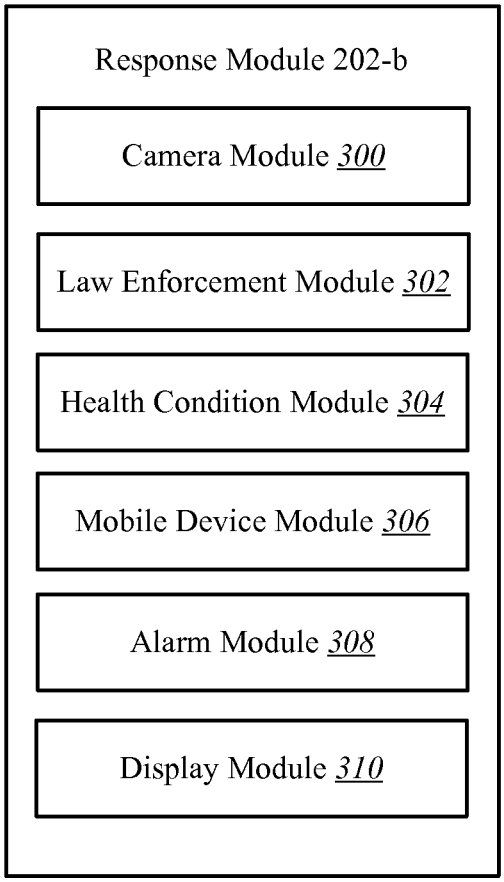
FIG. 3 is a block diagram of an example of a response module of the control unit of FIG. 2.

FIG. 3 is a block diagram illustrating one example of a response module 202-*b*. Response module 202-*b* may be one example of response module 202-*a* depicted in FIG. 2. In this example, the response module 202-*b* has a camera module 300, a law enforcement module 302, a health condition module 304, a mobile device module 306, an alarm module 308, and a display module 310.

The camera module 300 includes programmed instructions for controlling a video camera. In one example, the video camera may have a sleep mode that conserves energy if the premise of the home appears to be without activities of interest. However, certain sounds may be associated with activities of interest. Thus, in response to receiving the appropriate classifications, the camera module 300 may cause at least one video camera to turn on. The camera module 300 may also control other functions of the video camera. In some examples, the video camera may always be turned on, and the camera module 300 triggers a different function in response to receiving the recognized class. One such function may include what is covered in the camera's field of view. For example, if the recognized class is classified as a breaking kitchen door sound, the camera module 300 may response by turning the camera so that the camera's field of view captures footage of activities happening around the kitchen door. In other examples, the camera module 300 may zoom in or out as part of a predetermined response.

While the camera module 300 may include specific predetermined responses associated with the receipt of a recognized class, the camera module 300 may also include the ability to make dynamic decisions depending on the situation. For example, if the predetermined response is to turn on the camera, the camera module may make additional decisions beyond the predetermined response as appropriate. Such additional decisions may include zooming, panning, trucking, tilting, or otherwise controlling the camera's field of view if the camera's or the control unit's logic determines that the field of view could be positioned differently to get more useful information. In other examples, the video camera may detect the presence of a hazard, such as a fire, flooding, an intruder, other hazards, or combinations thereof. In response to such detections, the camera module 300 may cause additional types of appropriate predetermined responses to occur.

The law enforcement module 302 can send messages to law enforcement. Such a predetermined response may be appropriate for situations where the recognized class of sounds includes a security issue, such as the detection of an intruder, a fight, another type of situation, or combinations thereof. The law enforcement module 302 may be activated in combination with other modules so that multiple appropriate predetermined responses are executed. In some examples, the law enforcement module 302 is activated in response to user input. In such an example, the predetermined response may include sending an option to the user to have law enforcement notified. In such a situation, the user may be informed about the recognized sound classification, provided with a recording of the sound, provided with other types of information, or combinations thereof.

The health condition module 304 can send messages to medical personnel. For example, if the sound belongs a recognized class that is associated with an injury, the health condition module 304 may be notified to summon the medical assistance. Sounds that may be assigned to such a recognized class include choking sounds, falling sounds, yelling sounds, explosion sounds, gunshot sounds, other types of sounds, or combinations thereof. In some cases, where the sounds indicate that there is a potential danger to the medical personnel, like explosion or gunshot sounds, the medical personnel may still be notified and allow the medical personnel to be aware that their services may be requested. The medical personnel can coordinate their rescue efforts with the appropriate rescue agency.

The user may specify which types of sounds should trigger a predetermined response to the health condition module 304. If an elderly person lives in a home, the types of sounds that may indicate a potential health concern may be different for those homes where the younger children live. For example, falling sounds from an elderly person's home may have a greater potential to indicate that there is a health condition than in a younger person's home. In such a situation, the homeowner can specify that such sounds are to be associated with notifying medical personnel responses. In another example, some residents in a home may also have specific health conditions that are associated with certain types of sounds that the homeowner can select to trigger medical personnel.

The mobile device module 306 may be used to send messages or other types of information to the user's mobile device. For example, the user may receive a notification about any of the sounds that are deemed appropriate to share with the user. Further, the mobile device module 306 may also give the user options for how to respond to any appropriate type of notification. For example, if the detected sound indicates that the washing machine or dishwasher is broken, the user may receive a notification through his or her mobile device about the broken appliance. In some situations, the notification may also include an option that can be selected by the user about whether to notify an appropriate repair person to fix the appliance. In other examples, the mobile device module 306 sends a notification to the user that a fire alarm, a carbon monoxide alarm, a security alarm, a weather alarm, or another type of alarm is sounding in the home. In such situations, the notification to the mobile device is generated through hearing the alarm's sound with the security system component 104, and not through a notification mechanism directly integrated with the system sounding the alarm.

The alarm module 308 can trigger an alarm to be sounded in response to the detection of a sound that indicates specific types of conditions present on the premise. For example, a security alarm may be triggered in response sounds indicating that glass is breaking, an intruder is present, other types of conditions, or combinations thereof.

The display module 310 can cause messages to appear on the control unit 102. In such an example, any of the messages that can be sent to the mobile device can be presented in a display on the control unit 102. In some examples, the display on the control unit 102 may include additional options or details about the condition. In some cases, such a message may include an option for the user to select. Such an option may involve proper user authentication. For example, if the message deals with the detection of an intruder, the user authentication prevents the intruder from selecting a response to his presence. In other situations, the message may deal with a detected health condition and the user may be given the option to call medical personnel through the control unit 102.

Figure 4:
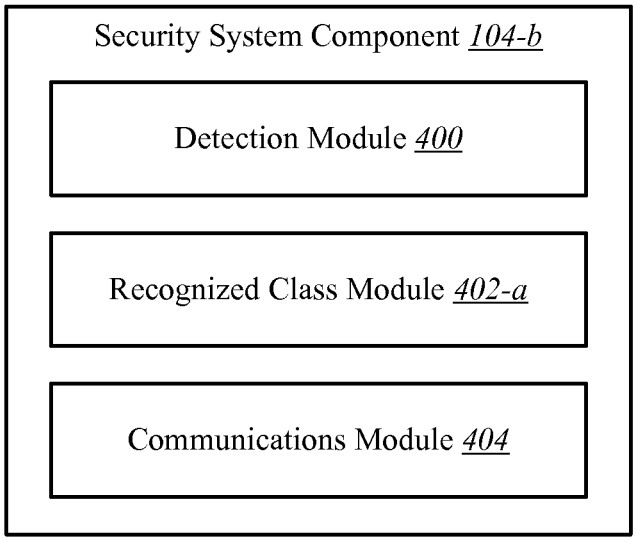
FIG. 4 is a block diagram of an example of a security system component of the environment of FIG. 1.

FIG. 4 is a block diagram illustrating one example of a security system component 104-*b*. Security system component 104-*b* may be one example of security system component 104-*a* depicted in FIG. 1. In this example, the security system component 104-*b* includes a detection module 400, a recognized class module 402-*a*, and a communications module 404.

The detection module 400 detects the sound. Such a module may incorporate a microphone or another type of device that is capable to detecting sounds. The detection module 400 may also include the ability to capture the attributes of the sound, such as waveform characteristics, decibel levels, sound durations, other types of sound attributes, or combinations thereof. Further, the detection module 400 may break out such sound attributes into categories that are easy for analysis. In other examples, the detection module 400 plots the waveform in a chart for comparison with stored signatures associated with different recognized classes. In some cases, the detection module 400 operates just when the security system is armed. However, in other cases, the detection module 400 can also operate when the security system is disarmed.

The recognized class module 402-*a* determines which class to associate with the detected sound. This may be through an analysis of the sound's attributes provided by the detection module 400. In some examples, the waveform plot of the sound is compared to the stored signatures in a class library of the security system component 104-*b*.

The communications module 404 communicates with the control unit 102. Such communications may be wireless communications or wired communications. The communications module 404 may send the identified recognized class to the control unit 102, where the control unit 102 can make a decision about how to respond to the recognized class. Thus, the analysis for determining the sound's recognized class is performed at the security system component 104-*b* and the decision for how to respond to the recognized class is performed at the control unit 102.

In some cases, sounds detected by the detection module 400 will not have enough similarity to the stored signatures. In such an example, the recognized class module 402-*a* may indicate that such a sound is unclassified. In some examples, the unclassified sounds are not sent to the control unit 102. As a result, no predetermined action is triggered when such a sound is detected.

By not responding to unclassified sounds, the system reacts to just those sounds that are predetermined to have a response. Thus, if the sound of car passing by a home does not fall within a recognized class, the security system will not initiate a predetermined response. Likewise, other sounds that are not predetermined to have a response, will not result in a predetermined response based on the classification of the sound type. In another example, if a baby crying sound above a specified decibel threshold falls into a recognized class associated with a predetermined response, and a baby cries at a decibel level below the specified threshold, there may be no response taken by the security system.

Figure 5:
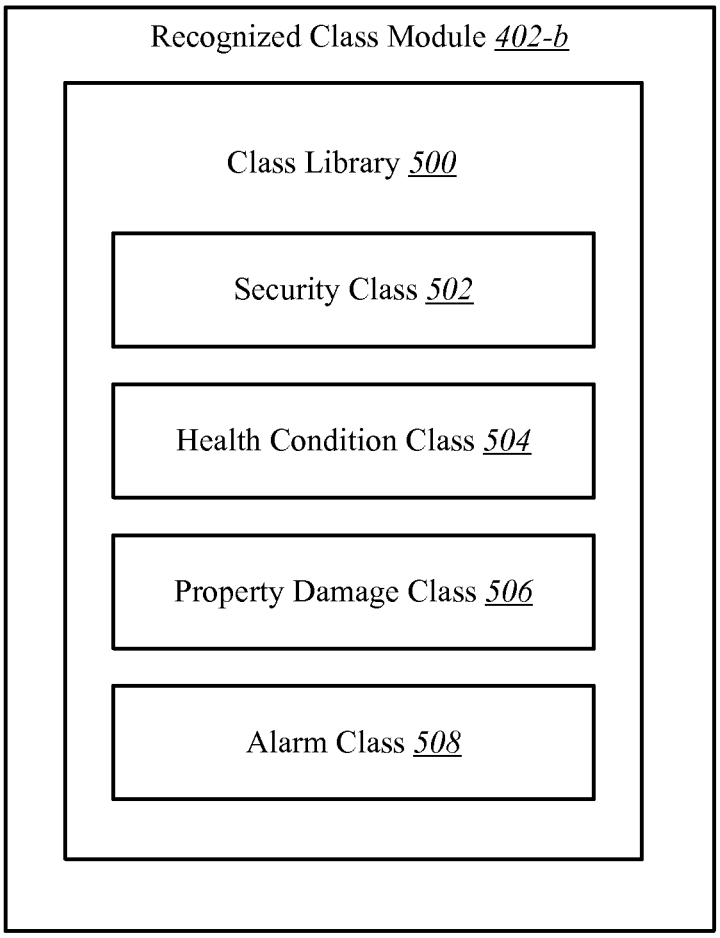
FIG. 5 is a block diagram of an example of a recognized class module of the security system component of FIG. 4.

FIG. 5 is a block diagram illustrating one example of a recognized class module 402-*b*. Recognized class module 402-*b* may be one example of recognized class module 402-*a* depicted in FIG. 4. In this example, the recognized class module 402-*b* includes a class library 500, which includes a security class 502, a health condition class 504, property damage class 506, and an alarm class 508. Other appropriate types of classes may also be included.

The class library 500 may include classes that each contain at least one stored sound signature or at least one set of sound attribute ranges that can be used to identify sounds that fall within the recognized class. The class library 500 may include any type of data that may be used to determine how to classify the detected sound.

The security class 502 may include sounds that involve some kind of security condition on the premise. For examples, sounds like breaking glass, breaking doors, certain types of explosives, sounds associated with a person moving in the dark, other types of sounds, gunshot sounds, yelling sounds, other types of sounds, or combinations thereof may be included in the security class.

The health condition class 504 may include sounds that indicate that a person on the building's premise is experiencing an emergency health related condition. Such sounds may include falling sounds, choking sounds, yelling sounds, explosion sounds, gunshot sounds, other types of sounds, or combinations thereof.

The property damage class 506 may be associated with sounds that include those types of sounds that indicate that damage is happening to the building. Such sounds may include breaking glass sounds, shaking sounds, breaking door sounds, flooding sounds, explosion sounds, cracking sounds, other types of sounds, or combinations thereof.

The alarm class 508 may include those sounds that are associated with alarm sounds in the building. Such alarm sounds may include fire alarm sounds, carbon monoxide alarm sounds, security alarm sounds, weather alarm sounds, earthquake alarm sounds, other types of alarm sounds, or combinations thereof.

Figure 6:
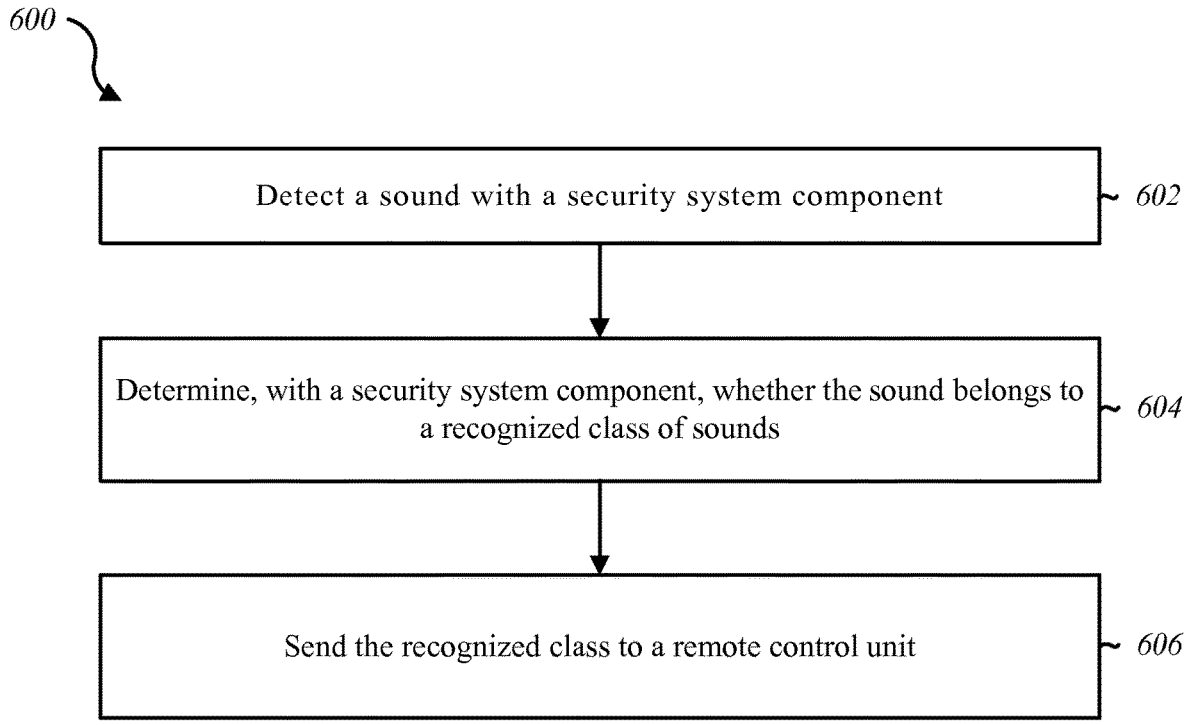
FIG. 6 is a flow diagram illustrating an example of a method for detecting a premise condition.

FIG. 6 is a flow diagram illustrating one embodiment of a method 600 for detecting a premise condition. In this example, the method 600 includes detecting 602 a sound with a security system component, determining 604 with a security system component whether the sound belongs to a recognized class of sounds, and sending 606 the recognized class to a remote control unit. Such a method 600 may be implemented with a security system component 104 shown in FIGS. 1 and/or 4. In other examples, method 600 may be performed generally by the environment 100 shown in FIG. 1.

At block 602, a sound is detected with the security system component 104. Such a sound may be a sound that indicates a condition on the premise where some kind of predetermined response is desirable.

At block 604, the security system component 104 determines whether the sound belongs to a recognized class of sounds. This may be done by comparing the attributes of the detected sound with a set of sound attributes or a sound signature stored on the security system component.

At block 606, the recognized class is sent to a remote control unit 102. At the remote control unit, a decision to take action and/or what action to take is made based on the recognized class.

Figure 7:
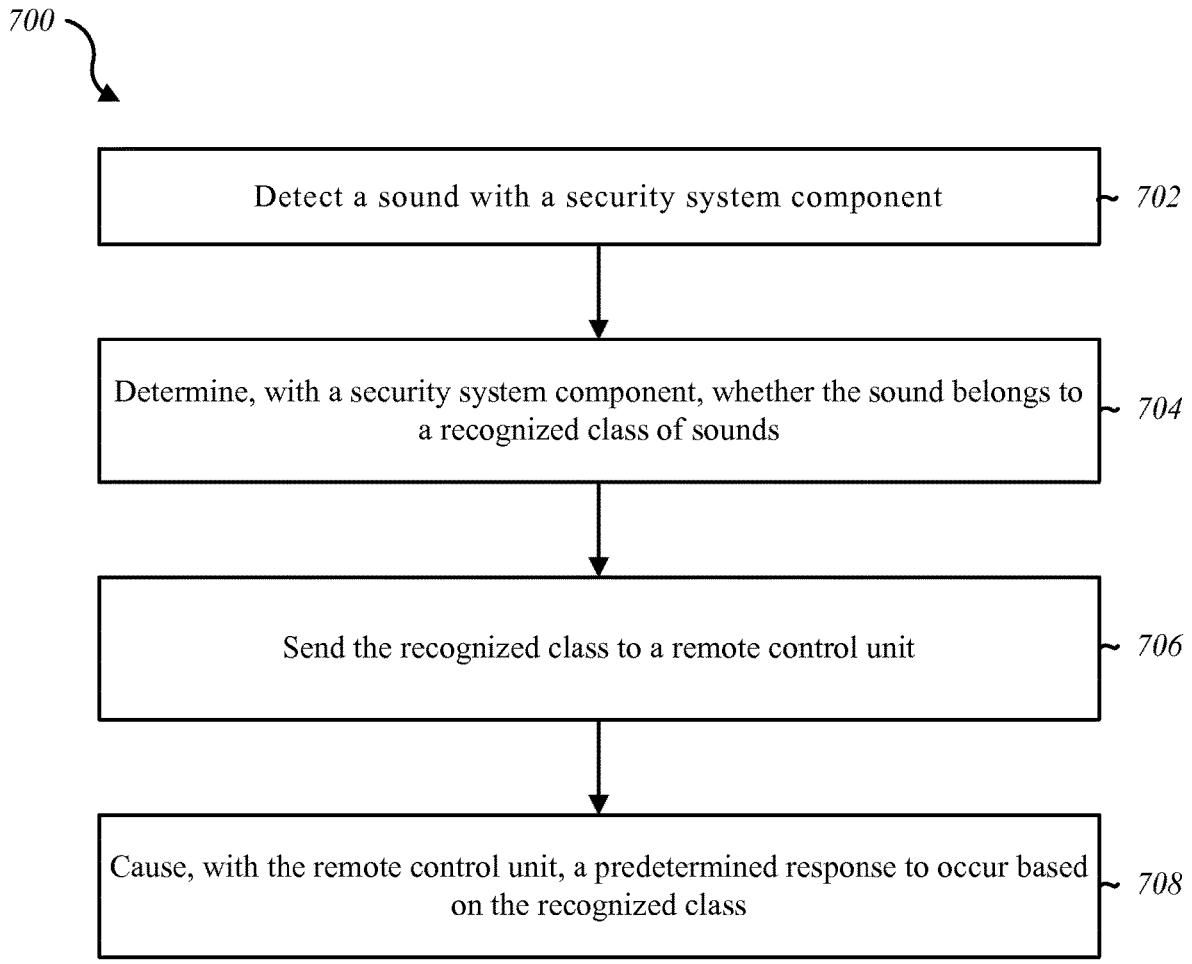
FIG. 7 is a flow diagram illustrating an example of a method for detecting a premise condition.

FIG. 7 is a flow diagram illustrating one embodiment of a method 700 for detecting a premise condition. In this example, the method 700 includes detecting 702 a sound with a security system component, determining 704 with a security system component whether the sound belongs to a recognized class of sounds, and sending 706 the recognized class to a remote control unit. Such a method 700 may be implemented with a security system component 104 and a control unit 102 shown in FIGS. 1, 2 and/or 4. In other examples, method 700 may be performed generally by the environment 100 shown in FIG. 1.

At block 708, the remote control unit 102 causes a predetermined response to occur based on the recognized class received at the control unit 102. The predetermined class may be identified by consulting a table that associates the recognized classes with predetermined responses. Such predetermined responses may be preprogrammed responses, default responses, user selected responses, other types of responses, or combinations thereof. Such responses may include sending messages to mobile phones, control unit displays, law enforcement, medical personnel, rescue agencies, fire departments, flooding control, other devices, other organizations, or combinations thereof.

Figure 8:
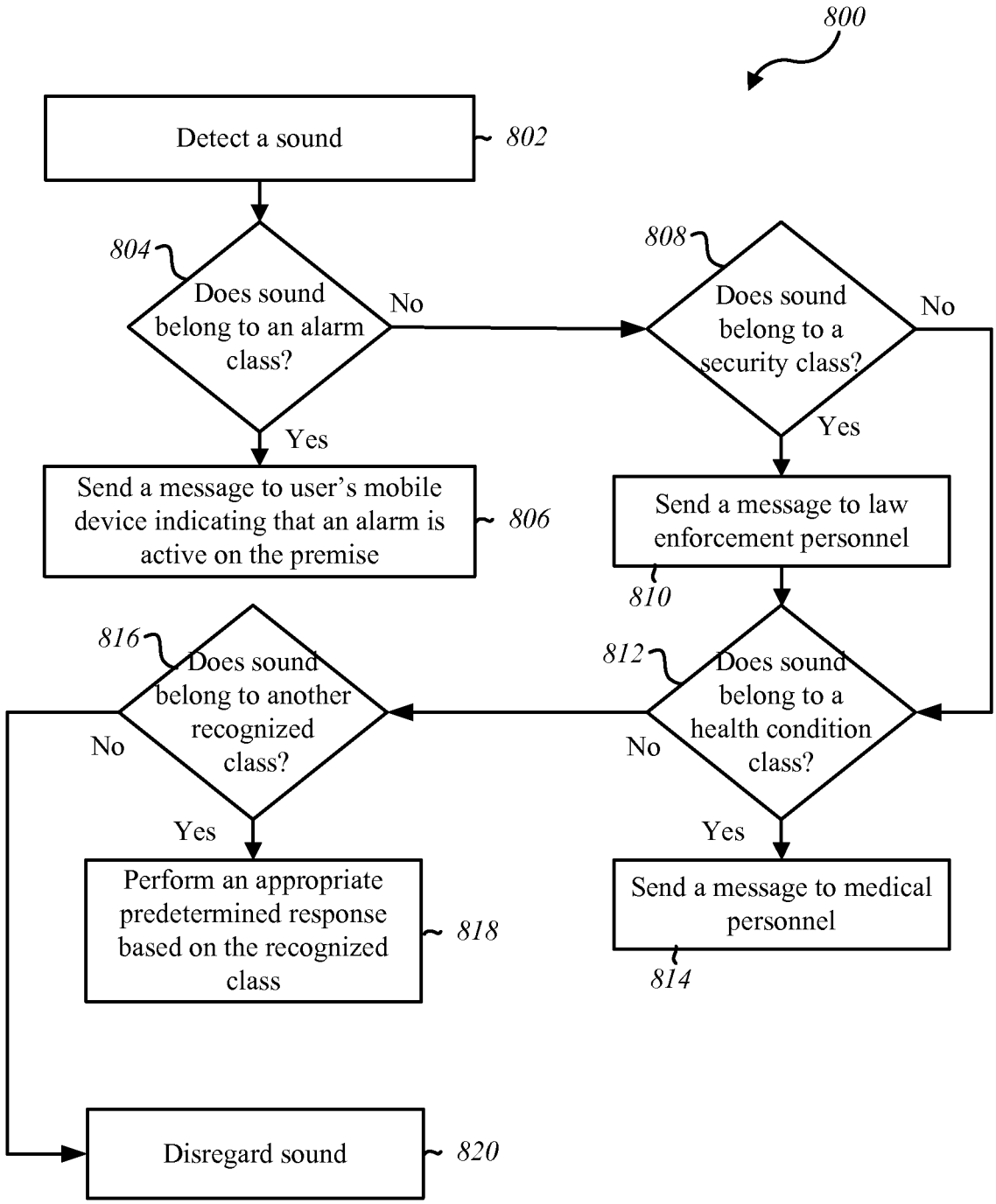
FIG. 8 is a flow diagram illustrating an example of a method for detecting a premise condition.

FIG. 8 is a flow diagram illustrating one embodiment of a method 800 for detecting a premise condition. Such a method 800 may be implemented with a control unit and/or security system component shown in FIGS. 1, 2 and/or 4. In other examples, method 800 may be performed generally by the environment 100 shown in FIG. 1.

At block 802, a sound is detected and a determination 804 is made as to whether the sound belongs to an alarm class. If the sound belongs to an alarm class, a message is sent 806 to a user's mobile device indicating that an alarm is active on the premise. In some examples, an identification of the alarm type is included in the notification. If the sound does not belong to the alarm class, another determination 808 is made. This determination 808 is whether the sound belongs to a security class. If the sound belongs to the security class, a message is sent 810 to law enforcement personnel. In some examples, an identification of the security sound type is included in the notification to law enforcement.

If the sound does not belong to a security class, a determination 812 is made to whether the sound belongs to a health condition class. If the sound belongs to the health condition class, a message is sent to medical personnel, such as a nurse, ambulance, emergency room, other types of medical facilities, or combinations thereof. In some examples, an identification of the health related sound type is included in the notification to the medical personnel.

If the sound does not belong to a health condition class, another determination 816 is made as to whether the sound belongs to another types of recognized class. If the sound belongs to another recognized class, then an appropriate response is performed 818 based on the recognized class. If the sound does not belong to another type of recognized class, then the sound is disregarded 820 by the system and no predetermined response is initiated.

While this example has been described with reference to a particular example of how to determine recognized classes and performing predetermined responses, any appropriate mechanism for determining recognized classes and executing predetermined responses may be implemented according to the principles described herein. For example, instead of sequentially evaluating the detected sounds as outlined above, the method 800 may evaluate the sound against the criteria of each recognized class in any appropriate order. Further, more or less recognized classes may be considered than depicted in the example of FIG. 8. Additionally, while the examples above identify a single predetermined response for specific recognized classes, any appropriate number of predetermined responses and any appropriate type of predetermined response may be used in accordance with the principles described herein. Further, in other examples, a detected sound may belong to more than one recognized class. As such, the detected sound may be compared to multiple recognized classes, even if the sound characteristics already satisfy the requisite conditions to fall within one of the recognized classes.

Further, each recognized class may include any appropriate number and types of sounds. In some examples, a recognized class may include multiple types of sounds with drastically different characteristics. For examples, a security class may include both a breaking glass sound which includes a high pitch and also a gunshot sound which includes different characteristics. In other examples, there is a different class for each of the breaking glass sounds and the gunshot sounds. Thus, a recognized class may contain a range of sounds from a single sound to hundreds of different sounds.

Figure 9:
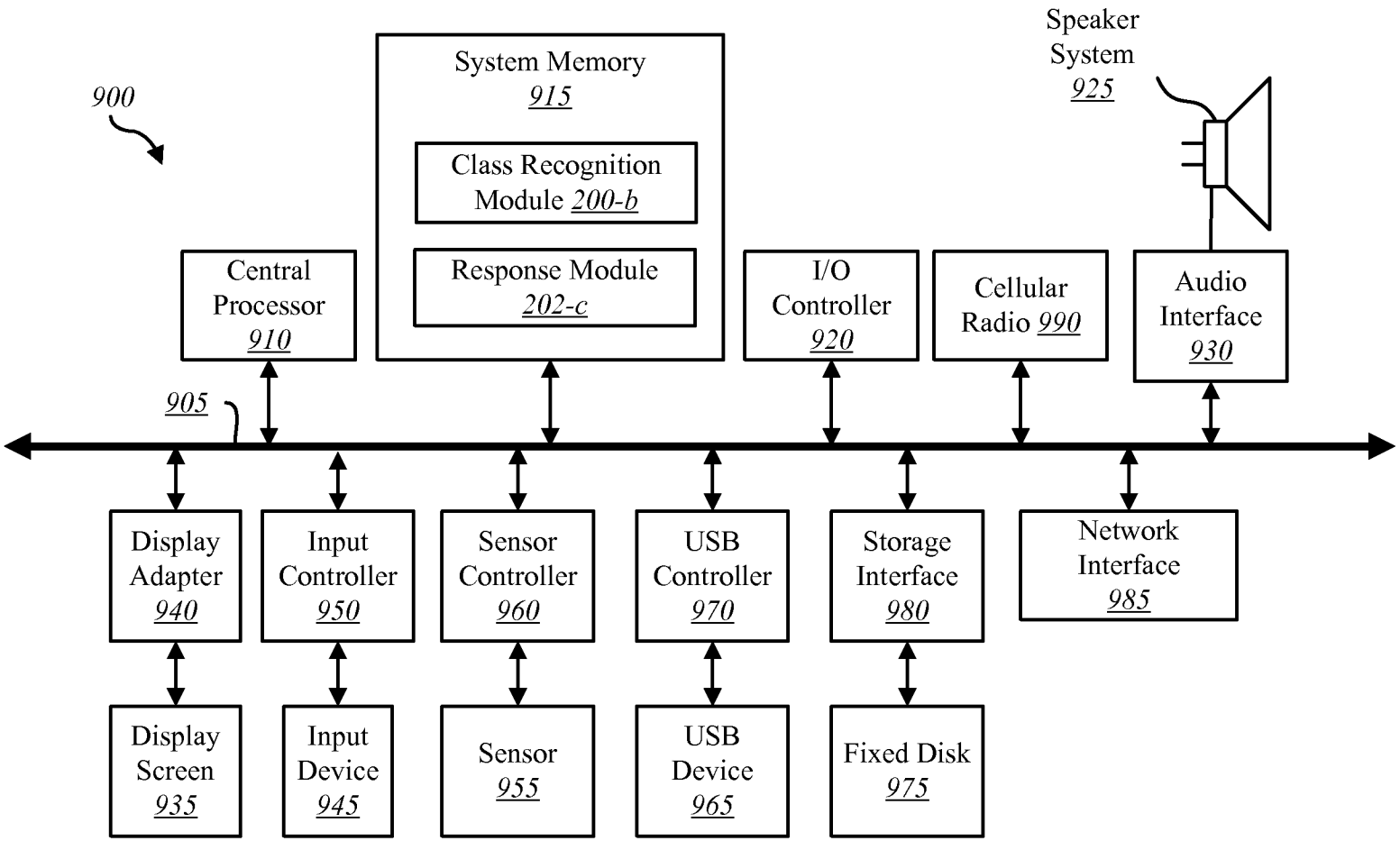
FIG. 9 is a block diagram of a computer system suitable for implementing the present systems and methods of FIG. 1.

FIG. 9 depicts a block diagram of a controller 900 suitable for implementing the present systems and methods. The controller 900 may be an example of the control unit 102-*a* in FIG. 1. In one configuration, controller 900 includes a bus 905 which interconnects major subsystems of controller 900, such as a central processor 910, a system memory 915 (typically RAM, but which may also include ROM, flash RAM, or the like), an input/output controller 920, an external audio device, such as a speaker system 925 via an audio output interface 930, an external device, such as a display screen 935 via display adapter 940, an input device 945 (e.g., remote control device interfaced with an input controller 950), multiple USB devices 965 (interfaced with a USB controller 970), one or more cellular radios 990, and a storage interface 980. Also included are at least one sensor 955 connected to bus 905 through a sensor controller 960 and a network interface 985 (coupled directly to bus 905).

Bus 905 allows data communication between central processor 910 and system memory 915, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, a class recognition module 200-*b* and a response module 202-*c* may be used to implement the present systems and methods may be stored within the system memory 915. Class recognition module 200-*b* may be one example of class recognition module 200-*a* depicted in FIG. 2. Response module 202-*c* may be one example of response module 202-*a* depicted in FIG. 2 and response module 202-*b* depicted in FIG. 3. Applications resident with controller 900 are generally stored on and accessed via a non-transitory computer readable medium, such as a hard disk drive (e.g., fixed disk 975) or other storage medium. Additionally, applications can be in the form of electronic signals modulated in accordance with the application and data communication technology when accessed via network interface 985.

Storage interface 980, as with the other storage interfaces of controller 900, can connect to a standard computer readable medium for storage and/or retrieval of information, such as a fixed disk drive 975. Fixed disk drive 975 may be a part of controller 900 or may be separate and accessed through other interface systems. Network interface 985 may provide a direct connection to a remote server via a direct network link to the Internet via a POP (point of presence). Network interface 985 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 900 wirelessly via network interface 985. In one configuration, the cellular radio 990 may include a receiver and transmitter to wirelessly receive and transmit communications via, for example, a cellular network.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 9 need not be present to practice the present systems and methods. The devices and subsystems can be interconnected in different ways from that shown in FIG. 9. The aspect of some operations of a system such as that shown in FIG. 9 are readily known in the art and are not discussed in detail in this application. Code to implement the present disclosure can be stored in a non-transitory computer-readable medium such as one or more of system memory 915 or fixed disk 975. The operating system provided on controller 900 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A method for detecting a premise condition, comprising:

detecting a sound with a processor;

determining, with the processor, one or more attributes of the sound;

determining, with the processor, a degree of correlation between the one or more attributes and one or more sound signatures;

determining, with the processor, that the sound belongs to a first recognized class of sounds and a second recognized class of sounds based at least in part on the degree of correlation; and causing, with the processor, a first predetermined response to occur based at least in part on the first recognized class to which the sound belongs and a second predetermined response to occur based at least in part on the second recognized class to which the sound belongs.

2. The method of claim 1, wherein at least one of the first recognized class and the second recognized class is a security class, an alarm class, or a combination thereof.

3. The method of claim 1, wherein at least one of the first recognized class and the second recognized class is a health condition class.

4. The method of claim 1, wherein at least one of the first recognized class and the second recognized class is a property damage class.

5. The method of claim 1, wherein the sound comprises the sound from a group consisting of crying baby sounds above a predetermined threshold, barking dog sounds, breaking glass sounds, talking sounds, alarm sounds, or combinations thereof.

6. The method of claim 1, wherein performing the first predetermined response, the second predetermined response, or both, comprises causing the video camera to exit a sleep mode.

7. The method of claim 1, wherein performing the first predetermined response, the second predetermined response, or both, comprises sending a message to law enforcement.

8. The method of claim 1, wherein performing the first predetermined response, the second predetermined response, or both, comprises sending a message to medical personnel.

9. The method of claim 1, wherein performing the first predetermined response, the second predetermined response, or both, comprises displaying a message on a security panel.

10. The method of claim 1, wherein performing the first predetermined response, the second predetermined response, or both, comprises activating an alarm.

11. The method of claim 1, wherein performing the first predetermined response, the second predetermined response, or both, comprises sending a notification to a mobile device.

12. A video camera for detecting a premise condition, comprising:

a processor;

memory in electronic communication with the processor; and instructions stored in the memory, the instructions being executable by the processor to:

detect a sound;

determine one or more attributes of the sound;

determine a degree of correlation between the one or more attributes and one or more sound signatures;

determine that the sound belongs to a first recognized class of sounds and a second recognized class of sounds based at least in part on the degree of correlation; and cause a first predetermined response to occur based at least in part on the first recognized class to which the sound belongs and a second predetermine response to occur based at least in part on the second recognized class to which the sound belongs.

13. The video camera of claim 12, wherein the memory comprises a recognized class library.

14. The video camera of claim 13, wherein the recognized class library comprises a health condition class, a security class, a property damage class, an alarm class, or combinations thereof.

15. A computer-program product for detecting a premise condition, the computer-program product comprising a non-transitory computer-readable medium having instructions thereon, the instructions being executable by a processor to:

detect a sound;

determine one or more attributes of the sound;

determine a degree of correlation between the one or more attributes and one or more sound signatures;

determine that the sound belongs to a first recognized class of sounds and a second recognized class of sounds based at least in part on the degree of correlation; and cause a first predetermined response to occur based at least in part on the first recognized class to which the sound belongs and a second predetermined response to occur based at least in part on the second recognized class to which the sound belongs.

16. The computer-program product of claim 15, wherein at least one of the first predetermined response and the second predetermined response comprises sending a message to law enforcement authorities.

17. The computer-program product of claim 15, wherein at least one of the first predetermined response and the second predetermined response comprises sending a message to medical personnel.

18. The computer-program product of claim 15, wherein at least one of the first predetermined response and the second predetermined response comprises sending a notification to a mobile device.

19. The method of claim 1, wherein the one or more attributes comprises a waveform generated by the sound, a pitch of the sound, an amplitude of the sound, a decibel level of the sound, reflection characteristics of the sound, a period of the sound's wavelength cycle, an acoustic pressure of the sound, an intensity of the sound, a speed of the sound, a direction of the sound, or a combination thereof.

* * * * *